US010081474B2

(12) United States Patent
VanLoocke et al.

(10) Patent No.: US 10,081,474 B2
(45) Date of Patent: Sep. 25, 2018

(54) BAGS WITH POUR OPENING FEATURES

(71) Applicant: EXOPACK, LLC, Spartanburg, SC (US)

(72) Inventors: Cory VanLoocke, Spartanburg, SC (US); Ryan Cooper, Spartanburg, SC (US); S. Cory Blanton, Spartanburg, SC (US); Bobby Coccola, Spartanburg, SC (US); Maegan Day, Spartanburg, SC (US)

(73) Assignee: Coveris Flexibles US LLC, Chicago, IL (US)

( * ) Notice: Subject to any disclaimer, the term of this patent is extended or adjusted under 35 U.S.C. 154(b) by 0 days.

(21) Appl. No.: 15/110,614

(22) PCT Filed: Jan. 9, 2015

(86) PCT No.: PCT/US2015/010847

§ 371 (c)(1),
(2) Date: Jul. 8, 2016

(87) PCT Pub. No.: WO2015/106122

PCT Pub. Date: Jul. 16, 2015

(65) Prior Publication Data

US 2016/0325904 A1 Nov. 10, 2016

Related U.S. Application Data

(60) Provisional application No. 61/926,166, filed on Jan. 10, 2014.

(51) Int. Cl.
*B65D 30/20* (2006.01)
*B65D 33/16* (2006.01)
(Continued)

(52) U.S. Cl.
CPC ..... *B65D 75/5877* (2013.01); *B65D 31/10* (2013.01); *B65D 33/1691* (2013.01); *B65D 83/06* (2013.01)

(58) Field of Classification Search
CPC ..... B65D 75/5877; B65D 31/10; B65D 33/1691; B65D 83/06
See application file for complete search history.

(56) References Cited

U.S. PATENT DOCUMENTS 2,444,104 A * 6/1948 Marken ..... B65D 5/744 222/528
2,757,830 A * 8/1956 Hansen ..... B65D 5/068 222/528

(Continued)

OTHER PUBLICATIONS

International Search Report and Written Opinion dated May 15, 2015 in International Patent Application No. PCT/US2015/010847.

*Primary Examiner* — Frederick C Nicolas
(74) *Attorney, Agent, or Firm* — Holland & Hart LLP

(57) ABSTRACT

A bag is provided with a collapsible spout for directing the flow of the contents of the bag during pouring. The collapsible spout can include folds so that the collapsible spout can transition from a substantially flat undeployed configuration to a deployed spout-shaped configuration. The collapsible spout can also include a fastening mechanism so that an opening in the bag can be closed or resealed. A bag can also include a resealable opening for directing the flow of the contents of the bag during pouring. The resealable opening can include a panel with a fastening mechanism so that an opening in the bag can be closed or resealed.

17 Claims, 11 Drawing Sheets

(51) Int. Cl.
*B65D 75/58* (2006.01)
*B65D 83/06* (2006.01)

(56) References Cited

U.S. PATENT DOCUMENTS

| | | | | | |
|---|---|---|---|---|---|
| 2,772,823 | A | | 12/1956 | Plamann | |
| 3,896,979 | A | * | 7/1975 | Pehr | B65D 5/746 222/528 |
| 4,420,080 | A | * | 12/1983 | Nakamura | B65B 61/184 206/449 |
| 4,953,781 | A | | 9/1990 | Bryan | |
| 5,014,888 | A | * | 5/1991 | Bryan | B65D 5/744 222/541.5 |
| 5,439,102 | A | * | 8/1995 | Brown | A61B 17/06133 206/227 |
| 5,718,371 | A | * | 2/1998 | Smith | B65D 25/525 222/528 |
| 6,113,271 | A | * | 9/2000 | Scott | B65D 75/5838 206/494 |
| 6,296,388 | B1 | | 10/2001 | Galomb et al. | |
| 7,204,641 | B2 | | 4/2007 | Stolmeier | |
| 2004/0074955 | A1 | | 4/2004 | McKenna | |

* cited by examiner

BAGS WITH POUR OPENING FEATURES

RELATED APPLICATION

This application is the U.S. National Stage filing under 35 U.S.C. 371 of International Patent Application No. PCT/US2015/010847, filed on Jan. 9, 2015 and titled BAGS WITH POUR OPENING FEATURES, which claims the benefit of U.S. Provisional Application No. 61/926,166, filed on Jan. 10, 2014and titled BAGS WITH POUR OPENING FEATURES, each of which is incorporated herein by reference in its entirety.

TECHNICAL FIELD

The present disclosure relates generally to bags, and more particularly to bags with pour opening features. In some embodiments, the bags include spout features, including collapsible spout features which may be deployed to aid in pouring, as discussed more fully herein.

BRIEF DESCRIPTION OF THE DRAWINGS

The written disclosure describes illustrative embodiments that are non-limiting and non-exhaustive. Reference is made to certain of such illustrative embodiments depicted in the figures, in which.

DETAILED DESCRIPTION

Figure 1:
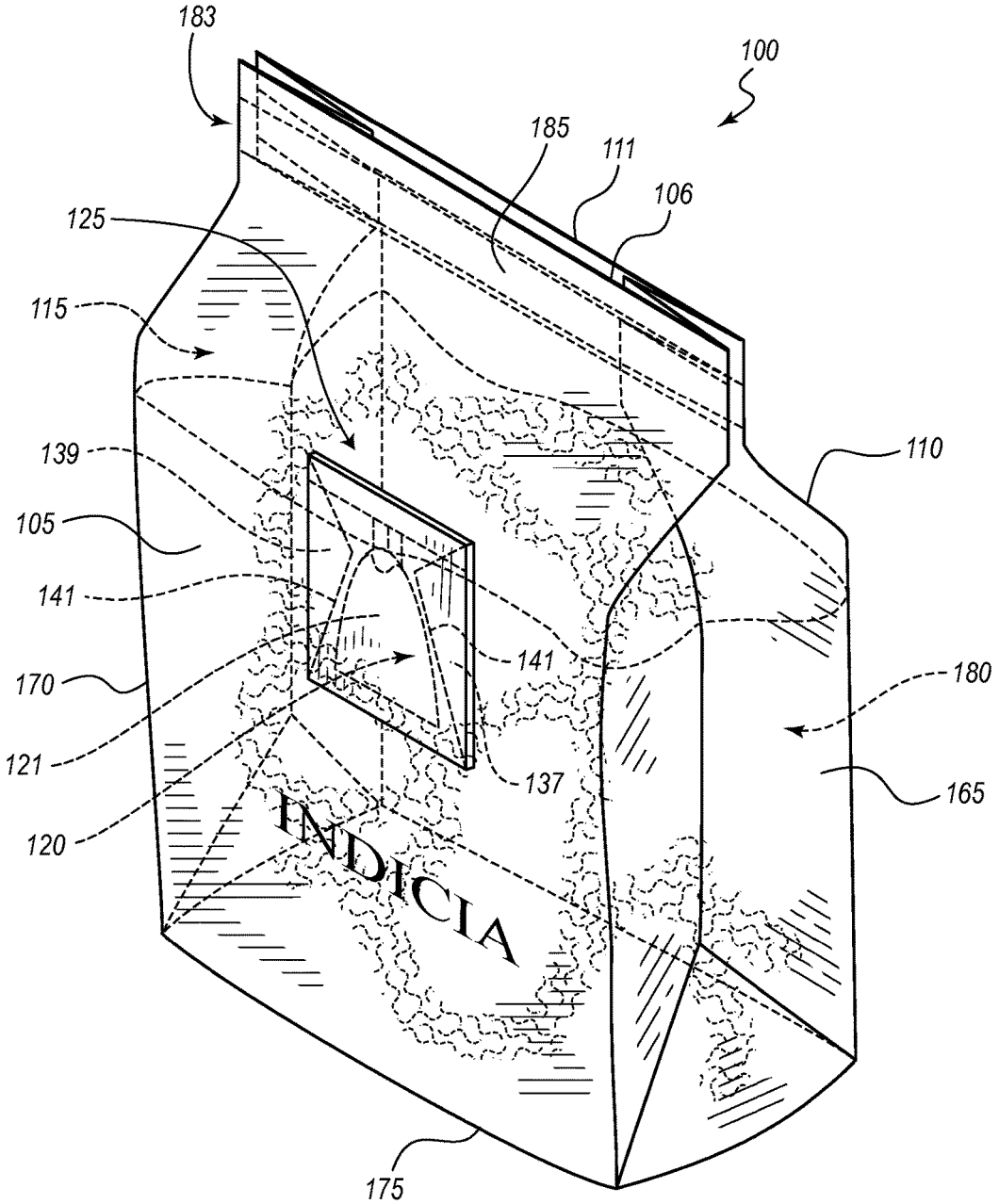
FIG. 1 is a perspective view of a bag comprising an embodiment of a collapsible spout in an undeployed configuration.

Embodiments may be best understood by reference to the drawings, wherein like parts are designated by like numerals throughout. It will be readily understood that the components of the present disclosure, as generally described and illustrated in the drawings herein, could be arranged and designed in a wide variety of different configurations. Thus, the following more detailed description of the embodiments of the apparatus is not intended to limit the scope of the disclosure, but is merely representative of possible embodiments of the disclosure. In some cases, well-known structures, materials, or operations are not shown or described in detail. While the various aspects of the embodiments are presented in drawings, the drawings are not necessarily drawn to scale unless specifically indicated.

Figure 2:
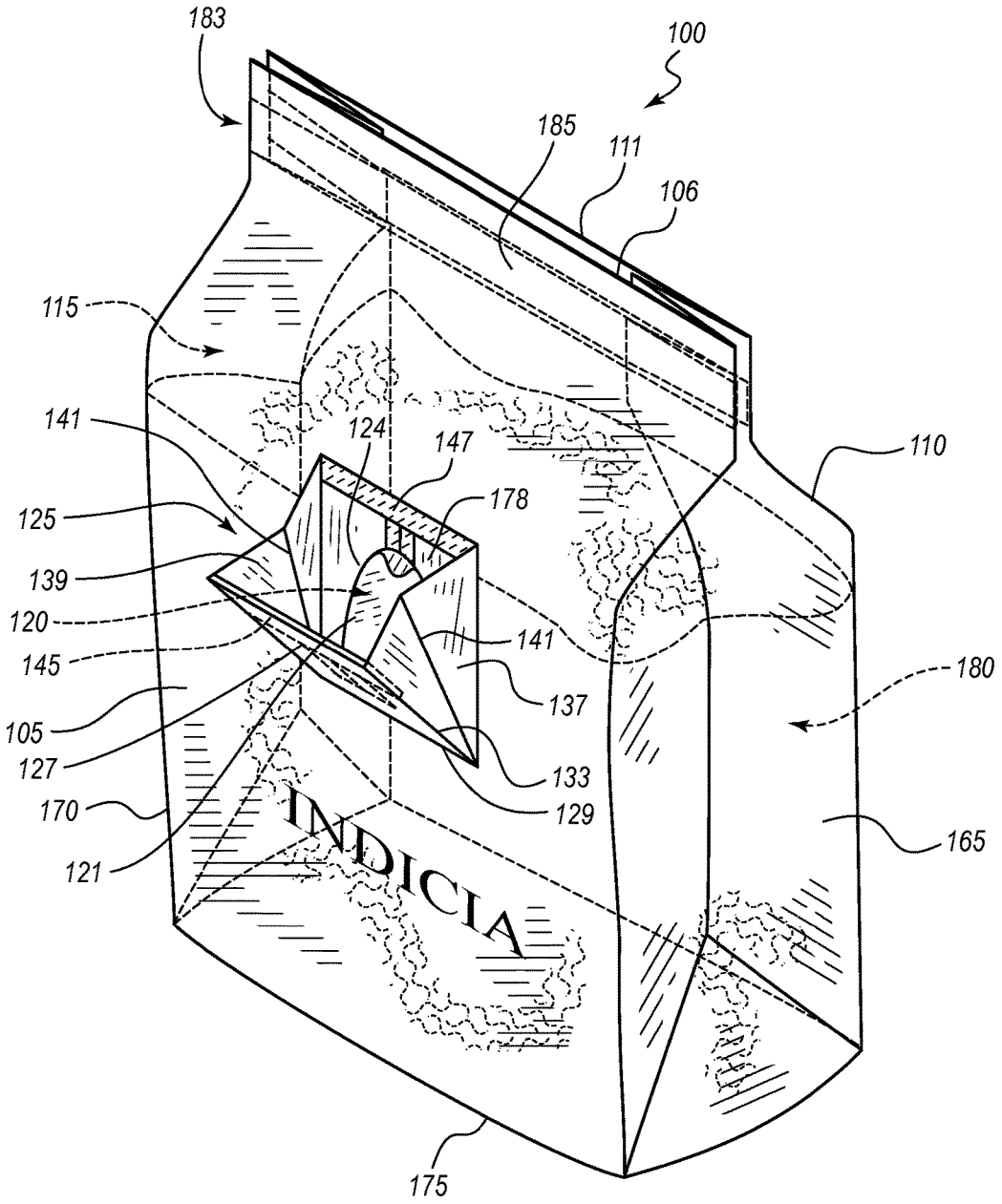
FIG. 2 is a perspective view of the bag of FIG. 1 wherein the collapsible spout is in a deployed configuration.

FIGS. 1 and 2 depict an embodiment of a collapsible spout 125, according to the present disclosure. More specifically, FIG. 1 is a perspective view of a bag 100 comprising a collapsible spout 125 wherein the collapsible spout 125 is in an undeployed configuration, and FIG. 2 is a perspective view of the bag 100 wherein the collapsible spout 125 is in a deployed configuration.

As shown in FIGS. 1 and 2, the bag 100 may comprise a first wall 105, a second wall 110, a first gusset 165, and a second gusset 170. The bag 100 may also comprise a third wall 175. Although FIGS. 1 and 2 primarily depict the first wall 105 and first gusset 165, it will be appreciated that the second wall 110 and second gusset 170 may comprise the same or similar features. For example, the second gusset 170 may be the same as, or substantially the same as, the first gusset 165. The second wall 110 may also be the same as, or substantially the same as, the first wall 105, except that in the illustrated embodiment the second wall 110 may not comprise the collapsible spout 125 and associated elements (e.g., label 121). In other embodiments, the collapsible spout 125 may be positioned on the first gusset 165, the second gusset 170, or the second wall 110, or the collapsible spout 125 may bridge a wall and a gusset (e.g., the collapsible spout 125 may be positioned such that it extends across a junction of the first wall 105 and the second gusset 170). As such, the discussion herein regarding many features of the first wall 105 and the first gusset 165 is equally applicable to the second wall 110 and second gusset 170, even though the features may not be specifically depicted.

In some embodiments, the collapsible spout 125 may be positioned on the third wall 175, or the collapsible spout 125 may bridge the third wall 175 and one or more of the first wall 105, second wall 110, first gusset 165, and/or second gusset 170. For example, the bag 100 may be configured to hang such that contents 180 of the bag 100 may be dispensed and/or gravity fed from at least a portion of the third wall 175.

With continued reference to FIGS. 1 and 2, the first wall 105, second wall 110, first gusset 165, second gusset 170, and third wall 175 may cooperate to define a cavity 115 in the interior of the bag 100. An opening 120 is configured to provide access to the cavity 115. Further, the collapsible spout 125 is coupled to an outside surface of the bag 100 such that the collapsible spout 125 is configured to resealably close or seal the opening 120. As depicted, the opening 120 is disposed along an upper portion of the first wall 105 of the bag 100. In other embodiments, the opening 120 may be disposed along a portion of the second wall 110, the first gusset 165, or the second gusset 170, or the opening 120 may extend across a junction between a wall and a gusset. The opening 120 may also be disposed at various positions along the first wall 105, second wall 110, first gusset 165, or second gusset 170. For example, the opening 120 may be positioned at a lower portion, a middle portion, or an upper portion of the bag 100, in relation to the third wall 175.

When the collapsible spout 125 is in the undeployed configuration, as shown in FIG. 1, the opening 120 may be blocked, or otherwise closed, and access to the cavity 115 of the bag 100 may be denied, limited, or otherwise restricted. Further, a label 121 may be used to cover the spout 125 and/or the opening 120 and deny access to the cavity 115 of the bag 100 until removed. The label 121 may also provide evidence or indication of tampering (i.e., tamper evidency) such that a user may know whether the bag 100 has been previously opened or whether contents 180 of the bag 100 may have been compromised. In some embodiments, the opening 120 may comprise a tamper evidency mechanism. In some other embodiments, the collapsible spout 125 may comprise a tamper evidency mechanism. Such a mechanism may provide a consumer or user with confidence that the bag or package has not been tampered with or opened.

With continued reference to FIGS. 1 and 2, it will be appreciated that the first and second gussets 165, 170 may serve various functions. For example, the first and second gussets 165, 170 may comprise a creased, folded, or pleated piece of material that is capable of transitioning from a flattened state to an expanded state. The first and second gussets 165, 170 may also be configured to permit portions of the first and second walls 105, 110 to be spaced apart from each other, as shown in the configuration depicted in FIGS. 1 and 2, to partially define the cavity 115.

The first and second gussets 165, 170 may also provide structural integrity to the bag 100. For example, as depicted in FIGS. 1 and 2, the first and second gussets 165, 170 extend from the first wall 105 to the second wall 110. Stated otherwise, the first and second gussets 165, 170 may be attached or otherwise directly coupled with each of the first and second walls 105, 110. The attachment of the first and second gussets 165, 170 to the first and second walls 105, 110 may provide relative rigidity and assist in maintaining the structural integrity of the bag 100.

In some embodiments, two or more of the first and second gussets 165, 170 and the first, second, and third walls 105, 110, 175 may be manufactured from a single piece of material. For example, the first and second gussets 165, 170 and the first, second, and third walls 105, 110, 175 may be formed from an integral piece of a polyethylene polymer. Any combination of single-piece or multiple-piece manufacture of the bag 100 is within the scope of this disclosure. Alternatively, the first and second gussets 165, 170 and the first, second, and third walls 105, 110, 175 may each be manufactured from separate pieces of material and coupled or pieced together to form the bag 100. In certain embodiments, one or more of the first and second gussets 165, 170 and the first, second, and third walls 105, 110, 175 may be formed from different types of material. For example, the first and second gussets 165, 170 may be formed from a polyethylene polymer, and the first, second, and third walls 105, 110, 175 may be formed from a paper material. Any combination of materials used to manufacture the bag 100 is also within the scope of this disclosure.

The bag 100, as illustrated in FIGS. 1 and 2, can also comprise an upper seam 185 that extends along an upper portion 183 of the bag 100. The upper seam 185 may extend along upper ends 106, 111 of the first and second walls 105, 110. The upper seam 185 can also extend along the upper portion 183 of the bag 100 at a distance that is below the upper ends 106, 111 of the first and second walls 105, 110. The upper seam 185 may be used to attach or otherwise directly couple the first wall 105 to the second wall 110. The upper seam 185 may also provide added stabilization and structural integrity to the bag 100. Other seams may also be used to provide additional stabilization, relative rigidity, and/or structural integrity to the bag 100 as desired.

The seams disclosed herein can be formed in various ways, and any suitable variety of seams may be used. In some embodiments, the seams may include seals such as heat seals. The seals can be configured to close (e.g., in an airtight, liquid-tight, and/or hermetic fashion) the bag 100. Any suitable variety of seals may be used. For example, in some embodiments, the seals comprise heat seals. In other embodiments, the seals may be formed via adhesive, ultrasonic welding, or any other suitable method.

The strength of the seams and/or seals may be varied as desired. For example, the amount of energy imparted when forming a seal can determine whether the seal will be a peel seal that can be readily opened or a lock seal that is much stronger and much more difficult, or even impossible, to open without damaging the bag 100. In various embodiments, the seams comprise lock seals such that the contents 180 of the bag 100 are only intended to be removed through the opening 120 on the first wall 105. For example, once the cavity 115 of the bag 100 has been filled with the contents 180, the upper seam 185 can be formed as a lock seal to close the upper portion 183 of the bag 100, after which the contents 180 may only be intended to be removed through the opening 120 disposed in the first wall 105. In other embodiments, the upper seam 185 may comprise a peelable seal that can be readily opened, and the contents 180 can be removed from the bag 100 either from the opening 120 in the first wall 105 or by the opening created by separating the upper seam 185.

Figure 3:
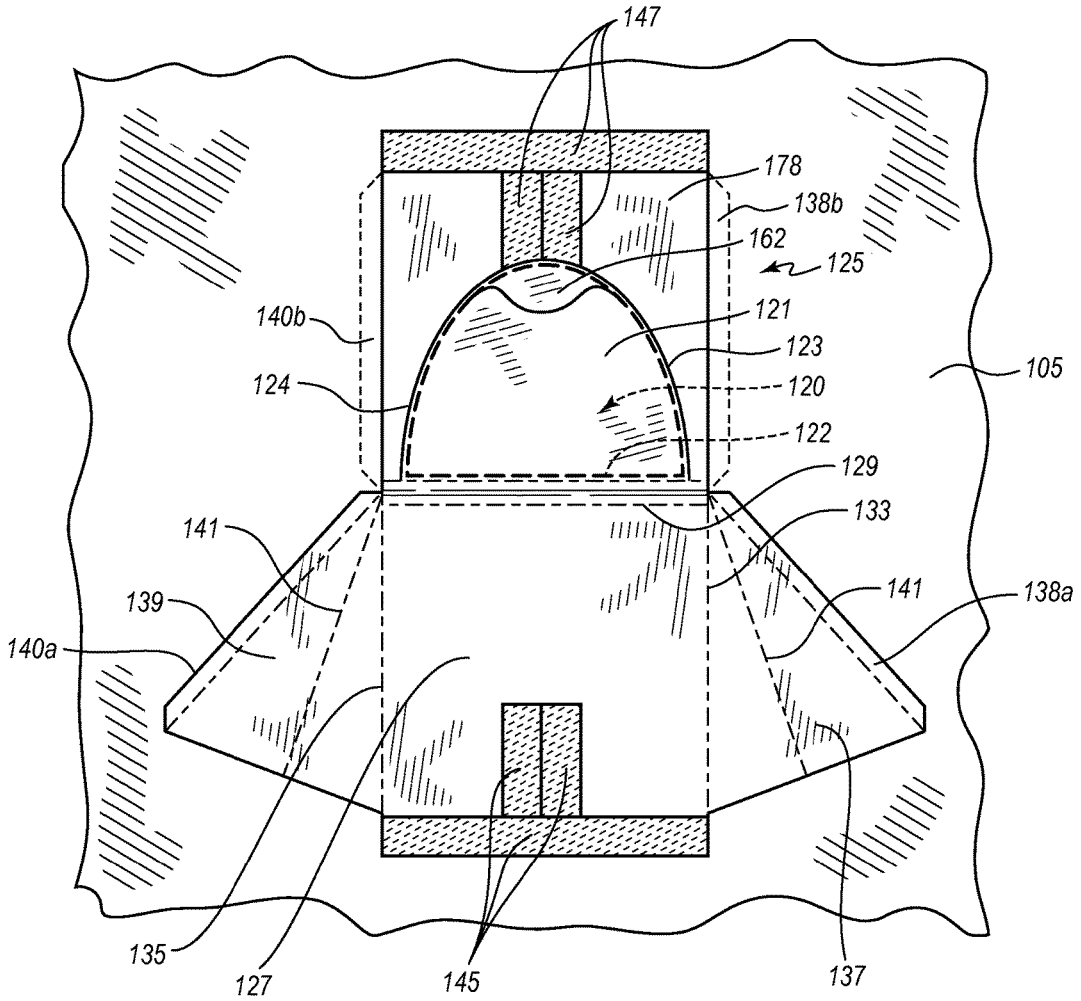
FIG. 3 is a plan view of the collapsible spout of FIG. 1 shown partially detached from the bag.

FIG. 3 is a plan view of the collapsible spout 125 of FIG. 1, wherein the spout 125 is shown partially detached from the bag 100 for clarity. Specifically, attachment portions 138*a*, 140*a* are depicted in a detached configuration. Attachment positions 138*b*, 140*b*, as illustrated by dashed lines, show where the attachment portions 138*a*, 140*a* may couple a portion of the collapsible spout 125 to the bag 100 in one embodiment. In the illustrated embodiment, a label 121 is disposed over the opening 120. The label 121 may be adhesively attached or coupled to the first wall 105 of the bag and/or the label 121 may be adhesively attached or coupled to a portion of the collapsible spout 125. The label 121 may also be peelable and/or removable. For example, the label 121 may be a removable perforated label that may be partially, or completely, removed from the bag to permit dispensing of the contents of the bag. The opening 120 can be sealed by the removable perforated label when the bag is in a closed configuration.

The label 121, as illustrated, may optionally comprise a pull tab 162 configured to ease removal of the label 121 from the bag. In some embodiments, the label 121 may comprise one or more pull tabs, like pull tab 162. The pull tabs may be gripped by a user to assist in peeling or otherwise removing the label 121 from the bag. For example, a user may grasp the pull tab 162 and pull the label 121 away from the first wall 105 to remove the label 121. In certain embodiments, the opening 120 may be configured for easy opening. For example, a closed or sealed opening 120 may be configured such that a user may be able to open or unseal the opening 120 without the use of a tool or utensil.

In some embodiments, the label 121 is non-resealable. In other words, the label 121 may be intended to be removed from the bag and/or the collapsible spout 125 and discarded. In other embodiments, the label 121 may be resealable, and may be reattached onto the first wall 105 of the bag and/or the collapsible spout 125 by the user. For example, the label 121 may comprise a resealable adhesive. The resealable adhesive may be disposed on a surface of the label 121, an outside surface of the bag 100 (e.g., the first wall 105 of the bag), and/or a portion of the collapsible spout 125. A user may remove the label 121 to gain access to the contents within the bag. The user may thereafter place the label 121 back over the opening 120 and reseal the label 121 on the first wall 105 and/or the collapsible spout 125. Illustrative resealable adhesives that may be used include, but are not limited to, hook and loop fasteners, hook and hook fasteners, acrylic adhesives, polyurethane adhesives, and hot melt adhesives. Other types of resealable adhesives may also be used.

In some embodiments, the opening 120 may formed by removing material from the first wall 105 during the manufacturing of the bag and/or removing material from the collapsible spout 125. For example the opening 120 may be die cut out of the first wall 105 and/or the collapsible spout 125. The opening 120 may also be laser scored and removed from the first wall 105 and/or the collapsible spout 125. In other embodiments, material is not removed from the first wall 105 during the manufacturing of the bag and/or from the collapsible spout 125 to form the opening 120. Rather, tear lines may be formed on the first wall 105 and/or the collapsible spout 125 such that a segment and/or segments of material from the first wall 105 and/or the collapsible spout 125 may be removed by a user when the bag is initially opened. The tear lines may be die cut, laser scored, or formed by other suitable methods.

In certain embodiments, tear lines may be formed on the first wall 105 and/or the collapsible spout 125 to define an opening region and a label 121 may be placed over the tear lines and opening region. The label 121 may also be adhesively attached to the segment of material within the tear lines. As the label 121 is removed, the segment of material from the first wall 105 and/or the collapsible spout 125 that is adhesively attached to the label 121 may be torn along the tear line and removed from the first wall 105 and/or the collapsible spout 125 thereby forming the opening 120. In other embodiments, the opening may be opened and closed with a zipper seal.

With reference to FIG. 2, when the collapsible spout 125 is in the deployed configuration, the opening 120 may provide access to the cavity 115 of the bag 100. The opening 120 may be sized and/or shaped to provide desired access to the cavity 115. For example, the opening 120 may be sized to allow the contents 180 of the bag 100 to be poured and/or shaken from the bag 100 in a controlled, metered, and/or smooth flow. As can be appreciated, the size and/or shape of the opening 120 may vary. For example, the size and/or shape of the opening 120 may vary depending on the size and/or shape of the contents 180 that are contained in the bag 100. In some embodiments, the shape of the opening 120 may be substantially circular, oval, rectangular, semicircular, square, or triangular. Other shapes and/or sizes of the opening 120 are also contemplated. In certain embodiments, the bag 100 and/or spout 125 may be configured such that the contents 180 are pourable from the bag 100 in a controlled, metered, and/or smooth fashion, wherein directed flow of the poured contents 180 may be maximized and scattered or untidy spreading of the poured contents 180 may be minimized.

Any variety of material may be used to form the bag 100. For example, in some instances, the material may be relatively stiff such that the bag 100 is sufficiently rigid to hold or maintain its structure or conformation. In other embodiments, the material that forms the bag 100 may be relatively flexible. The bag 100 may be formed from single or multiple layers of paper or a polymeric material, or combinations thereof. Each layer may provide the bag 100 with one or more desirable characteristics, depending on the planned use of the bag 100, such as moisture retention, grease resistance, and/or extra strength.

In some embodiments, the bag 100 may comprise a single-layer film. In other embodiments, the bag 100 may comprise a multi-layer film. As used herein, the term "film" refers to the material of which the bag 100 is formed, and may include both polymeric and paper components as discussed herein. The term "film" includes laminate, single-layer, and multi-layer polymeric products, and may comprise a fiber product. The bag 100 may also comprise a single ply or the bag 100 may comprise two or more plies. The bag 100 may also comprise a laminate or a coextruded material. In some embodiments, the bag 100 comprises a heat-sealable material. Exemplary materials that may be used in forming the bag 100 include polyethylene polymers and copolymers, polypropylene polymers and copolymers, polyester polymers and copolymers, and/or polyamide polymers and copolymers. In some embodiments, the bag 100 may include paper and/or cardboard materials alone or in combination with films, plies, laminates, and/or coextruded materials. In other embodiments, the bag 100 may not include paper and/or cardboard materials. In some embodiments, the bag 100 may include polylactic acid (PLA). In further embodiments, the bag 100 may include cellulose materials such as cellophane. In still other embodiments, woven polypropylene may be used. Other materials are also contemplated.

In many embodiments, a bag, like bag 100, may be manufactured on existing machinery. Likewise, in certain embodiments, the material of which the bag is ultimately formed may be selected such that the material may be formed into the bag on existing converting equipment. Further, the bag may advantageously be manufactured on existing equipment, such that investment in new and expensive bag manufacturing equipment may be unnecessary. In some embodiments, the bag may run on a user's manufacturing line at parity speeds. In yet other embodiments, a collapsible spout, like collapsible spout 125, may be applied to the bag on converting equipment. Additionally, the manufacture of the bag comprising the collapsible spout may be conducted at parity speeds.

In certain embodiments, the bag 100 may also comprise printed indicia of any suitable variety. The printed indicia may be disposed on any portion of the bag 100, such as the first wall 105, second wall 110, first gusset 165, second gusset 170, and/or third wall 175.

In some embodiments, the bag 100 may be configured to stand upright. In other words, the bag 100 may be capable of standing on its own. The bag 100 may also be substantially capable of maintaining its structural conformation. As shown in FIGS. 1 and 2, the third wall 175 may serve as a base on which the bag 100 rests. The first wall 105, second wall 110, first gusset 165, and second gusset 170 extend upwardly from the third wall 175. The first wall 105, second wall 110, first gusset 165, and second gusset 170 may also be attached or otherwise directly coupled to the third wall 175. In other embodiments, one or more of the first wall 105, second wall 110, first gusset 165, and second gusset 170 may be integrally formed with the third wall 175. A variety of other bag styles may also be used. For example, in certain embodiments, the bag may comprise a gusseted pinch-bottom bag configuration, a non-gusseted pinch-bottom bag configuration, a flat bottom, a folded bottom, other pinch-bottom bag configurations, a non-pinch straight heat-sealed bottom, and various self-opening sack (SOS) configurations. The bag may also have pouch configurations. Bags that are not configured to stand upright are also contemplated. For example, a bag may comprise a first wall, like first wall 105, and a second wall, like second wall 110, but no first gusset, second gusset, or third wall. In such an embodiment, the first wall and the second wall may cooperate to define at least a portion of a cavity, like cavity 115.

In embodiments comprising small or medium SOS bags, it may be advantageous to position a collapsible spout at an upper portion of a first or second wall. In such embodiments, the SOS bag may flex in or toward a middle portion creating a natural path for flow of bag contents. Such positioning may minimize engineering challenges and decrease possible financial investment in manufacturing. Such a configuration may also minimize the amount of product caught above the collapsible spout upon pouring. Also, the disclosed configuration may allow SOS bags comprising a collapsible spout to remain substantially flat during shipping to and filling at customer locations. In some embodiments of small or medium SOS bags, the gusset may be too small for positioning of a collapsible spout. Alternatively, in some other embodiments of small or medium SOS bags, a collapsible spout may be disposed or positioned on the gusset.

In certain embodiments, a collapsible spout, like collapsible spout 125, may be added to a pinch bag, such as a large pinch bag. In large pinch bag embodiments, the collapsible spout may be disposed on a gusset. Such a disposition of the collapsible spout may affect pourability of the contents. In some large pinch bag embodiments, die cutting in the gusset area and thickness increases due to the addition of the collapsible spout may skew the bag. Alternatively, in some other large pinch bag embodiments, die cutting in the gusset area and thickness increases due to the addition of the collapsible spout may not skew the bag. The cavity 115 may receive and retain the contents 180, as shown in FIGS. 1 and 2, wherein the contents 180 are shown in phantom. At a user's discretion, the contents 180 may be removed from the cavity 115 through the opening 120 and via the collapsible spout 125. The contents 180 may comprise, for example, pet food, or other loose bulk products. Other suitable contents 180 may also be retained within the cavity 115 of the bag 100. In some embodiments, the bag 100 may be comprised of material suitable to act as a barrier layer to preserve the contents 180 retained within the cavity 115.

Referring again to FIG. 2, the collapsible spout 125 is depicted in the deployed configuration. The collapsible spout 125 may be described as a foldable and/or deployable spout, indicating the spout's ability to transition from the undeployed configuration, wherein the spout is substantially flat, to the deployed configuration, wherein the spout is configured to provide for substantially smooth or directed pouring of the contents 180 from the bag 100. In certain embodiments, the collapsible spout 125 may be configured to collapse or fold into a substantially flat configuration or state when the collapsible spout 125 transitions from the deployed configuration to the undeployed configuration. When the collapsible spout 125 is in the deployed configuration and the label 121 has been removed, the bag 100 may be in an open or unsealed configuration, and when the collapsible spout 125 is in the undeployed configuration and the label 121 has been removed, the bag 100 may be in a closed or sealed configuration.

Referring to FIG. 3, the illustrated collapsible spout 125 comprises a first panel 127 comprising a first end 129, a first lateral end 133, and a second lateral end 135. At least a portion of the first end 129 may be coupled to the outside surface of the bag at a position that is adjacent an edge 122 of the opening 120. In FIG. 2, at least a portion of the first end 129 is coupled to the bag 100 at a position that is between the opening 120 and the third wall 175. The first end 129 of the first panel 127 remains coupled to the outside surface of the bag 100 when the collapsible spout 125 is in the deployed configuration. In certain embodiments, the first end 129 of the first panel 127 is not coupled to the outside surface of the bag 100, or alternatively, the first end 129 of the first panel 127 becomes decoupled from the outside surface of the bag 100 when the collapsible spout 125 is in the deployed configuration. In other embodiments, the collapsible spout 125 and the opening 120 may be positioned at other locations on the surface of the bag 100.

Referring to FIGS. 2 and 3, the collapsible spout 125 further comprises a first gusset 137 extending from the first lateral end 133 of the first panel 127, to the outside surface of the bag 100 at a position that is adjacent a first lateral edge 123 of the opening 120, and a second gusset 139 extending from the second lateral end 135 of the first panel 127 to the outside surface of the bag 100 at a position that is adjacent a second lateral edge 124 of the opening 120. The illustrated embodiment of the collapsible spout 125 further comprises a first fastener region 145 disposed on an inner surface of the first panel 127. In certain embodiments, the first fastener region 145 may comprise a fastener that is configured to couple the first panel 127 of the collapsible spout 125 to at least a portion of a second fastener region 147 disposed on an outside surface of a second panel 178 and/or disposed on the outside surface of the bag 100.

The fastener may be selected from at least one of a hook and hook fastener, a hook and loop fastener, an acrylic adhesive, a polyurethane adhesive, and/or a hot melt adhesive. Other adhesives or fasteners are also contemplated. In some embodiments, the collapsible spout 125 may be easily and/or securely reclosable. For example, the user may be able to easily transition the collapsible spout 125 from the deployed configuration to the undeployed configuration, and vice versa. The collapsible spout 125 may also be configured to remain in the undeployed configuration upon tipping or dropping of the bag 100. Additionally, in some embodiments, a portion of the contents 180 and/or granules of the contents 180 (i.e., fines) may remain on the fastener after repeated pouring. The fastener may be configured such that the fines that are caught in the fastener may not substantially hinder continued use of the fastener. Application and/or positioning of the fastener in a consistent and accurate manner during manufacture may be desirable. For example, consistent and accurate application of the fastener via a labeling system may be advantageous.

In the illustrated embodiment of FIGS. 1-3, both the first gusset 137 and the second gusset 139 comprise a fold 141, wherein the fold 141 is configured such that at least a portion of the first gusset 137 and at least a portion of the second gusset 139 bias or fold toward each other when the collapsible spout 125 transitions from the deployed configuration (as depicted in FIG. 2) to the undeployed configuration (as depicted in FIG. 1). As illustrated, the first and second gussets 137, 139 comprise a single fold 141. In other embodiments, the first and second gussets 137, 139 may comprise more than one fold, for example, two, three, or four folds, and so on. The fold or folds may also be arranged in different directions or orientations.

The collapsible spout 125 may be coupled to the bag 100 in various ways. In some embodiments the collapsible spout 125 may be coupled to the bag 100 via a seal, such as a heat seal. Any suitable variety of seal may be used. For example, the seal may be formed via an adhesive, heat seal, ultrasonic welding, or any other suitable method. In various embodiments, the bag 100 may be configured such that the contents 180 of the bag 100 (e.g., without limitation, pet food products) are intended to be removed from the bag 100 through the opening 120 via the collapsible spout 125.

Figure 4:
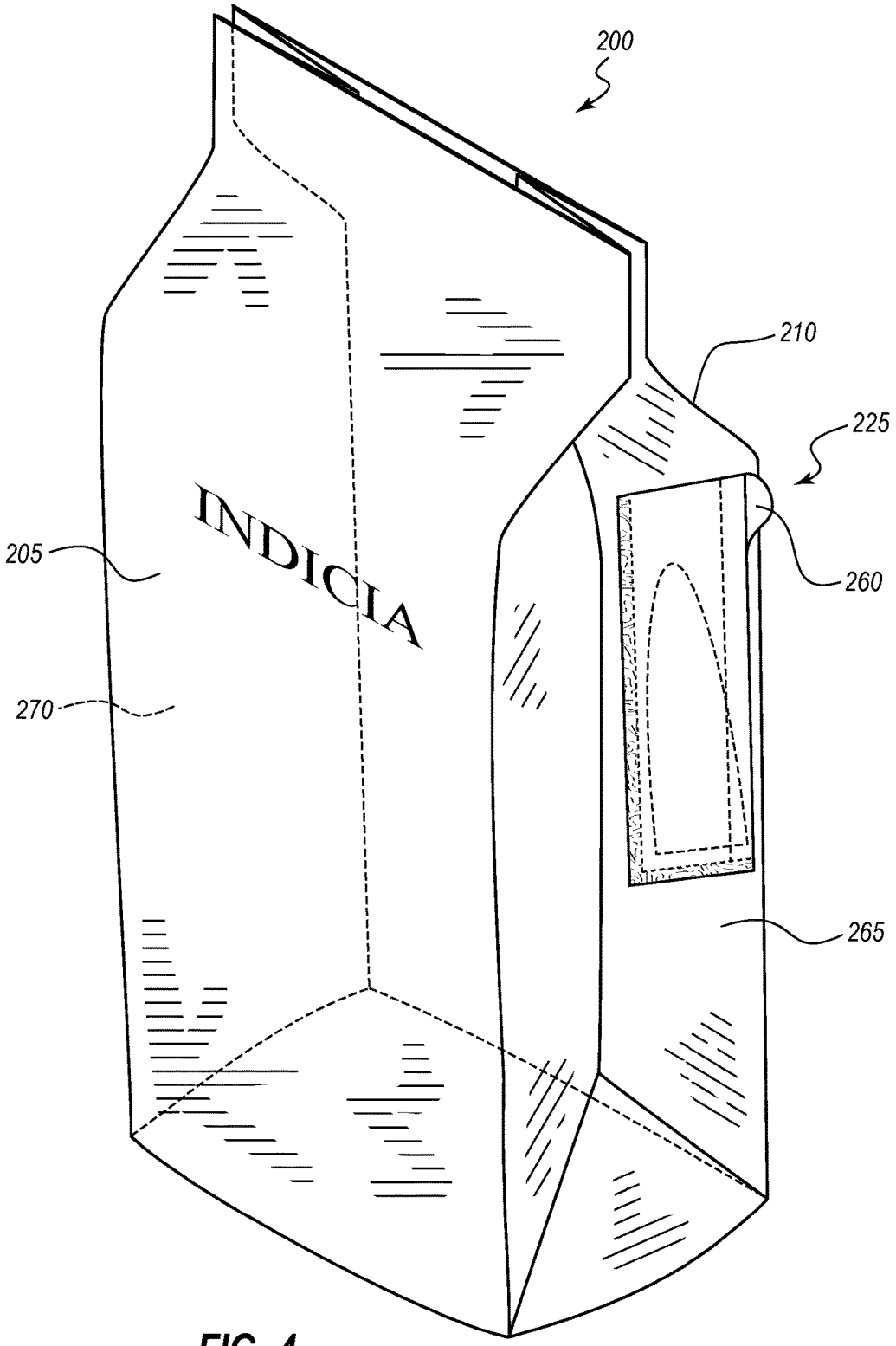
FIG. 4 is a perspective view of a bag comprising another embodiment of a collapsible spout in an undeployed configuration.
Figure 5:
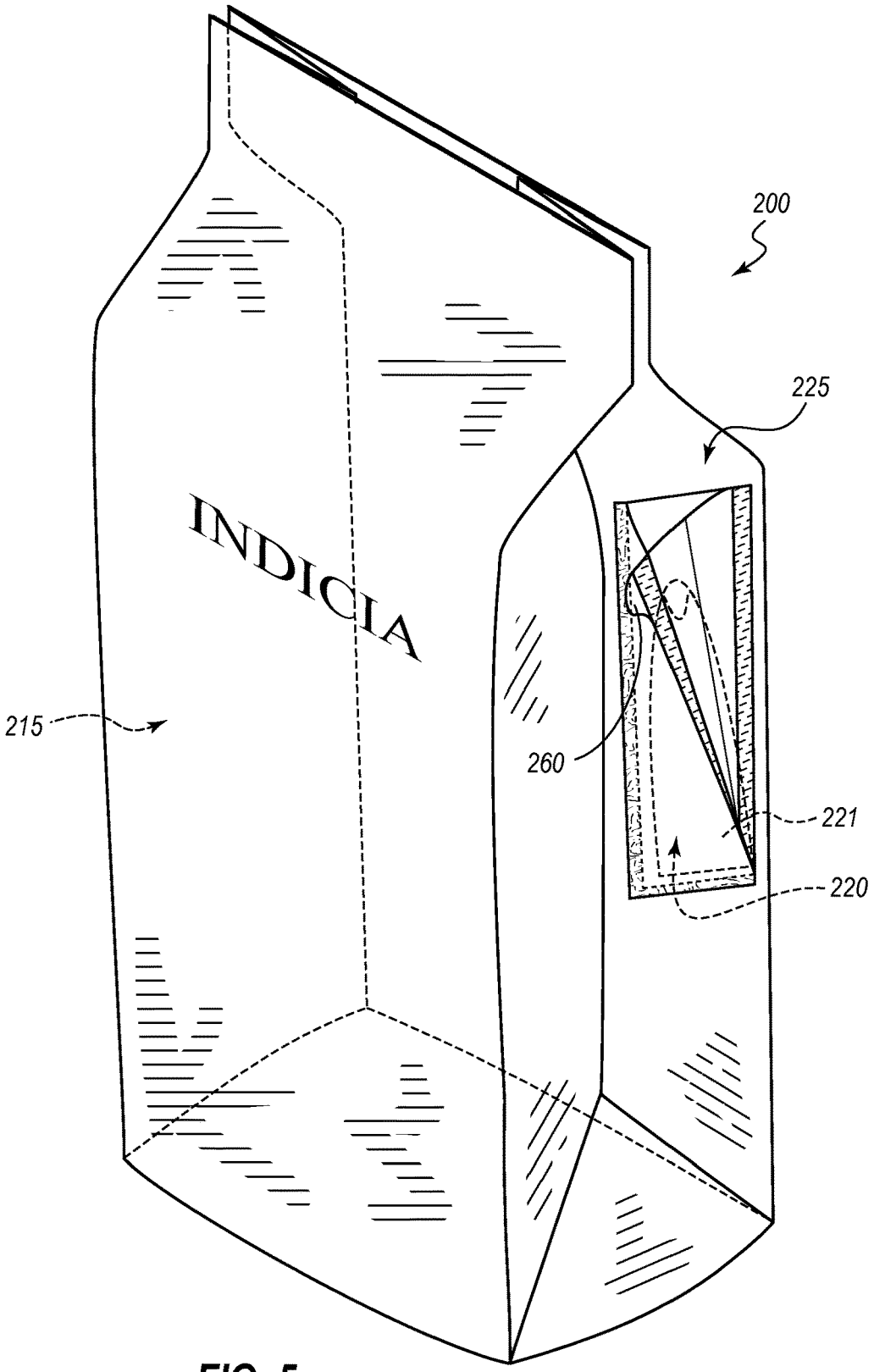
FIG. 5 is a perspective view of the bag of FIG. 4 wherein the collapsible spout is in a deployed configuration.

FIGS. 4 and 5 depict another embodiment of a bag 200 that can resemble the bag 100 described above in certain respects. Accordingly, like features are designated with like reference numerals, with the leading digits incremented to "2." Relevant disclosure set forth above regarding similarly identified features thus may not be repeated hereafter. Moreover, specific features of the bag 200 may not be shown or identified by a reference numeral in the drawings or specifically discussed in the written description that follows. However, such features may clearly be the same, or substantially the same, as features depicted in other embodiments and/or described with respect to such embodiments. Accordingly, the relevant descriptions of such features apply equally to the features of the bag 200. Any suitable combination of the features and variations of the same described with respect to the bag 100 can be employed with the bag 200, and vice versa. This pattern of disclosure applies equally to further embodiments depicted in subsequent figures and described hereafter, wherein the leading digits may be further incremented.

FIG. 4 is a perspective view of a bag 200 comprising another embodiment of a collapsible spout 225 in an undeployed configuration. As illustrated, the collapsible spout 225 is disposed on a first gusset 265 of the bag 200. In certain embodiments, the collapsible spout may alternatively be disposed on one of a first wall 205, a second wall 210, or a second gusset 270 of the bag 200. In other embodiments, the collapsible spout 225 may be disposed on the bag 200 such that the collapsible spout 225 extends across a junction of a wall and a gusset of the bag 200, as described above for collapsible spout 125.

FIG. 5 is a perspective view of the bag 200 of FIG. 4, wherein the collapsible spout 225 is in a deployed configuration. As shown, the collapsible spout 225 comprises a pull tab 260. The pull tab 260 may be configured to ease deployment or opening of the collapsible spout 225. In some embodiments, the collapsible spout 225 may comprise one or more pull tabs, like pull tab 260. The pull tabs may be gripped by a user to assist in deploying or opening the collapsible spout 225. For example, a user may grasp the pull tab 260 and pull at least a portion of the collapsible spout 225 away from the bag 200 to deploy the collapsible spout 225.

Figure 6A:
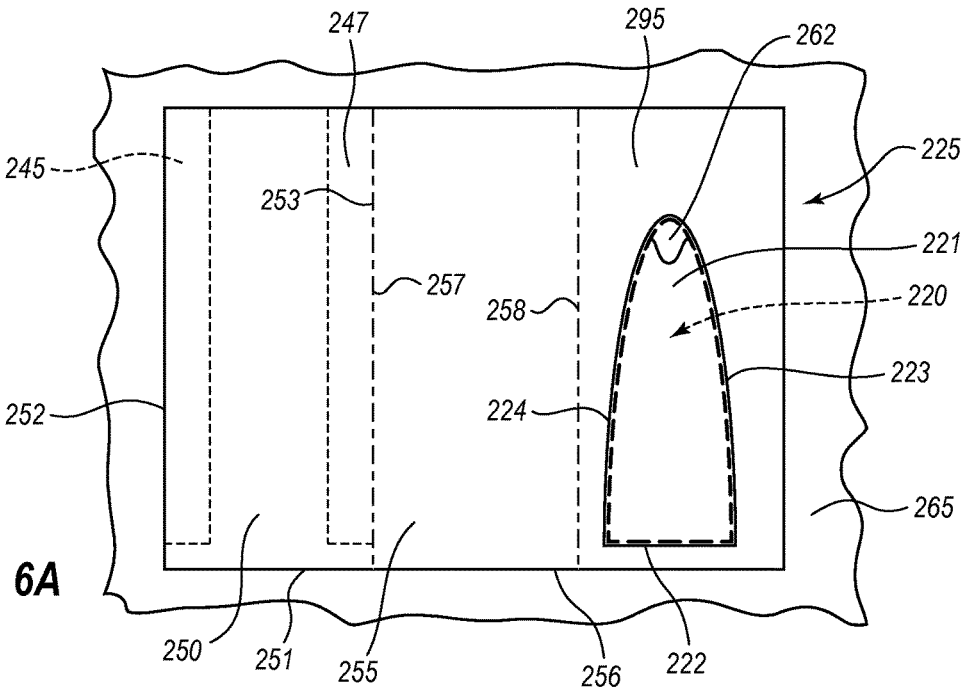
FIG. 6A is a plan view of the collapsible spout of FIG. 4 shown partially detached from the bag.
Figure 6B:
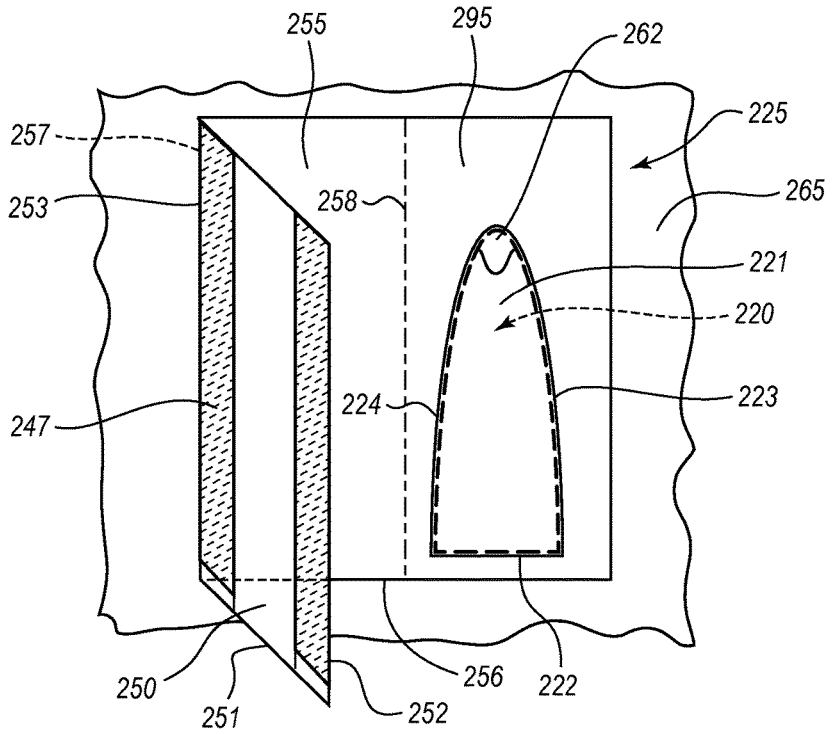
FIG. 6B is a second plan view of the collapsible spout of FIG. 4 shown partially detached from the bag.
Figure 6C:
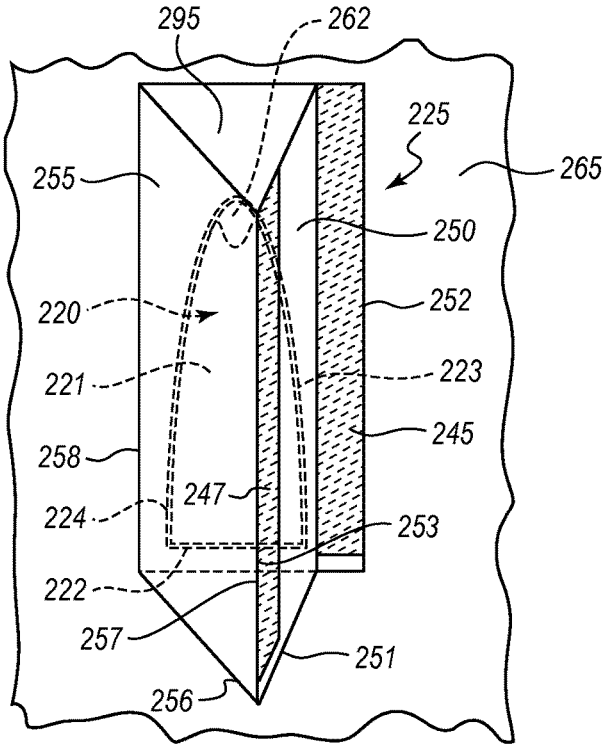
FIG. 6C is a third plan view of the collapsible spout of FIG. 4 shown partially detached from the bag.

Further, a label 221 may be used to cover the opening 220 and deny access to a cavity 215 of the bag 200. The label 221 may also provide tamper evidency so that a user may know whether the bag 200 has been previously opened or whether contents of the bag 200 may have been compromised. FIGS. 6A-6D depict various views of the collapsible spout 225. In FIGS. 6A-6C, the spout 225 is partially detached, to varying degrees, from the bag 200 for clarity. FIGS. 6A-6D depict various stages of an assembly of the collapsible spout 225 in at least one embodiment. In the illustrated embodiment, the label 221 is disposed over the opening 220. The label 221 may be adhesively attached or coupled to the first gusset 265 of the bag, and/or the label 221 may be adhesively attached or coupled to a portion of the collapsible spout 225. The label 221 may also be peelable and/or removable. For example, the label 221 may be a removable perforated label that may be partially, or completely, removed from the bag. The opening 220 can be sealed by the removable perforated label when the bag is in a closed configuration.

The label 221, as illustrated, comprises a pull tab 262 configured to ease removal of the label 221 from the bag and/or a portion of the collapsible spout 225. In some embodiments, the label 221 may comprise one or more pull tabs, like pull tab 262. The pull tabs may be gripped by a user to assist in peeling or otherwise removing the label 221 from the bag. For example, a user may grasp the pull tab 262 and pull the label 221 away from the first gusset 265 and/or collapsible spout 225 to remove the label 221.

In some embodiments, the label 221 is non-resealable. In other words, the label 221 may be intended to be removed from the bag and/or the collapsible spout 225 and discarded. In some embodiments, a non-resealable label 221 may be formed by perforations, a tear seam, or other suitable non-resealable configuration. In other embodiments, the label 221 may be resealable, and may be reattached onto the first gusset 265 of the bag and/or the collapsible spout 225 by the user. For example, the label 221 may comprise a resealable adhesive. The resealable adhesive may be disposed on a surface of the label 221, an outside surface of the bag (e.g., the first gusset 265 of the bag 200), and/or a portion of the collapsible spout 225. A user may remove the label 221 to gain access to the contents 280 within the bag. The user may thereafter place the label 221 back over the opening 220 and reseal the label 221 on the first gusset 265 and/or a portion of the collapsible spout 225. Illustrative resealable adhesives that may be used include hook and loop fasteners, hook and hook fasteners, acrylic adhesives, polyurethane adhesives, and hot melt adhesives. Other types of resealable adhesives may also be used.

In some embodiments, the opening 220 may be formed by removing material from the first gusset 265 during the manufacturing of the bag and/or removing material from the collapsible spout 225. For example the opening 220 may be die cut out of the first gusset 265 and/or the collapsible spout 225. A rotary system may be used in some embodiments to perforate or die cut the opening. The opening 220 may also be laser scored and removed from the first gusset 265 and/or the collapsible spout 225. In other embodiments, material is not removed from the first gusset 265 during the manufacturing of the bag and/or from the collapsible spout 225 to form the opening 220. Rather, tear lines may be formed on the first gusset 265 and/or the collapsible spout 225 such that a segment of material from the first gusset 265 and/or the collapsible spout 225 may be removed by a user when the bag is initially opened. The tear lines may be die cut, laser scored, or formed by other suitable methods. In certain embodiments, spray adhesive may be utilized to adhere layers around the opening. Additionally, during manufacturing, in-line application of an adhesive around the opening may be desirable.

In certain embodiments, tear lines may be formed on the first gusset 265 and/or the collapsible spout 225 to define an opening region and the label 221 can be placed over the tear lines and opening region. The label 221 may also be adhesively attached to the segment of material within the tear lines. As the label 221 is removed, the segment of material from the first gusset 265 and/or the collapsible spout 225 that is adhesively attached to the label 221 may be torn along the tear line and removed from the first gusset 265 and/or the collapsible spout 225 thereby forming the opening 220. In other embodiments, the opening may be opened and closed with a zipper seal.

Figure 6D:
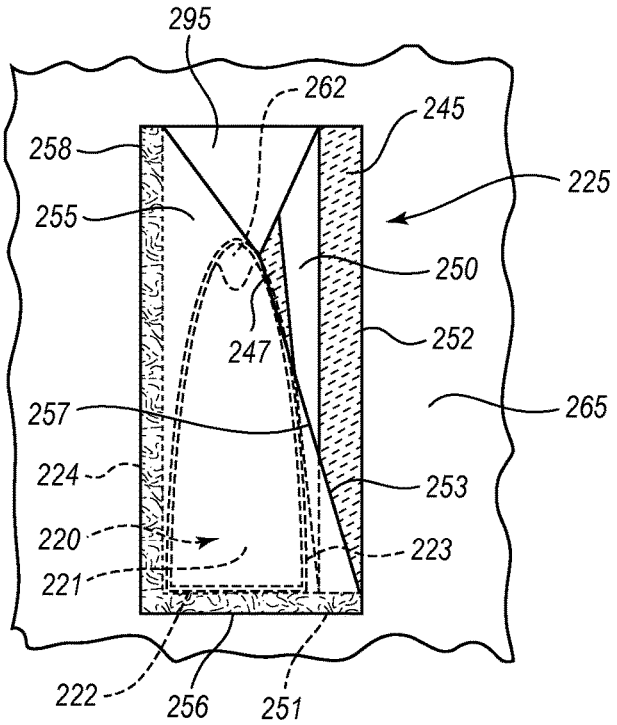
FIG. 6D is a fourth view of the collapsible spout of FIG. 4.

As shown in FIGS. 6C and 6D, the collapsible spout 225 comprises a first panel 250 comprising a first end 251, a first lateral end 252, and a second lateral end 253, wherein the first lateral end 252 is coupled to at least a portion of an outside surface of the bag at a position that is adjacent a first lateral edge 223 of the opening 220, and wherein at least a portion of the first end 251 is coupled to the outside surface of the bag at a position that is adjacent an edge 222 of the opening 220. The illustrated collapsible spout 225 further comprises a second panel 255 comprising a first end 256, a first lateral end 257, and a second lateral end 258, wherein the first lateral end 257 of the second panel 255 is coupled to the second lateral end 253 of the first panel 250. As illustrated, the second lateral end 258 of the second panel 255 is coupled to the outside surface of the bag and/or a third panel 295 of the collapsible spout 225 at a position that is adjacent a second lateral edge 224 of the opening 220. FIG. 6D illustrates the collapsible spout in a fully assembled configuration wherein the first end 256 of the second panel 255 is coupled to at least one of an outside surface of the first end 251 of the first panel 250 and/or the outside surface of the bag at a position that is adjacent the edge 222 of the opening 220.

With continued reference to FIGS. 6A-6D, the illustrated collapsible spout 225 further comprises a first fastener region 245 disposed on an outside surface of the first lateral end 252 of the first panel 250. The first fastener region 245 may comprise a fastener that is configured to couple at least a portion of the first lateral end 252 to a second fastener region 247 disposed on an outside surface of the second lateral end 253. In certain embodiments, the fastener may be selected from at least one of a hook and loop fastener, a hook and hook fastener, an acrylic adhesive, a polyurethane adhesive, a hot melt adhesive, or another suitable fastener and/or adhesive.

Figure 7A:
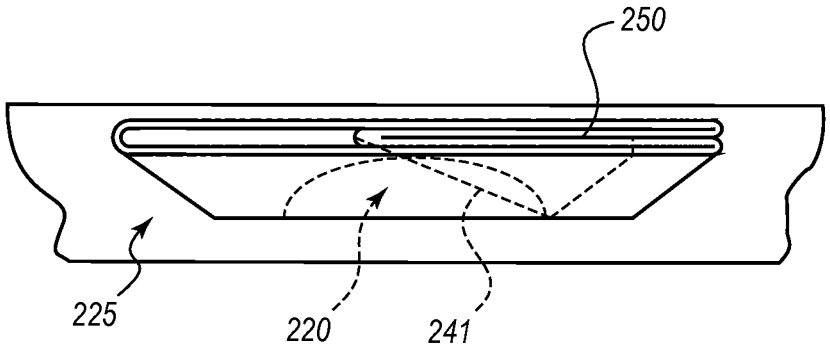
FIG. 7A is a top view of the collapsible spout of FIG. 4 in an undeployed configuration.
Figure 7B:
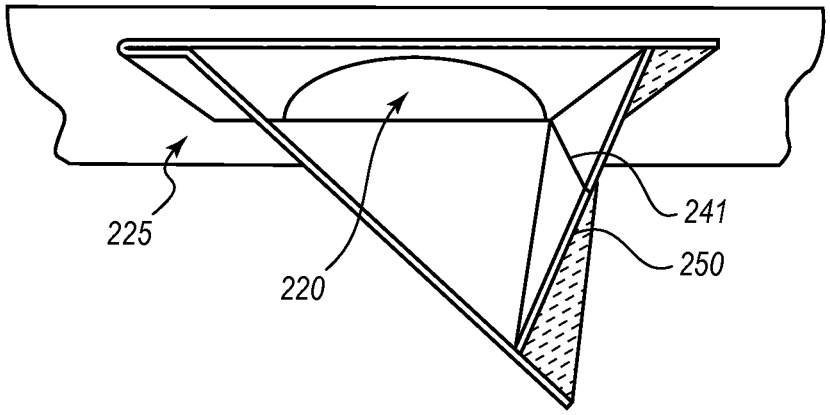
FIG. 7B is a top view of the collapsible spout of FIG. 4 in a deployed configuration.

FIG. 7A is a top view of the collapsible spout 225 of FIG. 4 in the undeployed configuration, and FIG. 7B is a top view of the collapsible spout 225 of FIG. 4 in the deployed configuration. In the illustrated embodiment of FIGS. 7A and 7B, the first panel 250 further comprises a fold 241 such that at least a portion of the first panel 250 is configured to bias toward the opening 220 when the collapsible spout 225 transitions from the deployed configuration, as in FIG. 7B, to the undeployed configuration, as in FIG. 7A.

Figure 8:
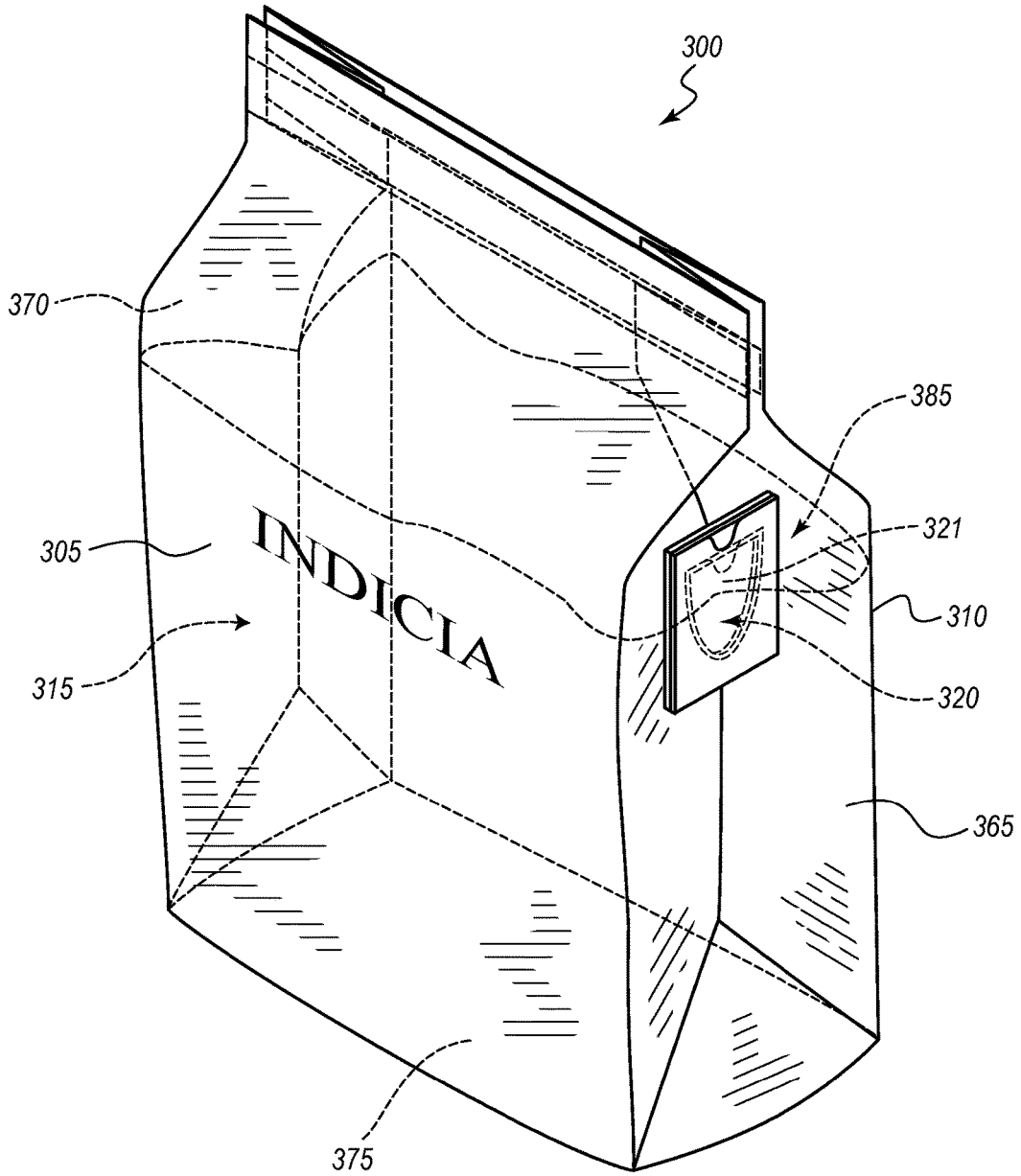
FIG. 8 is a perspective view of a bag comprising an embodiment of a resealable opening in a closed or sealed configuration.
Figure 9:
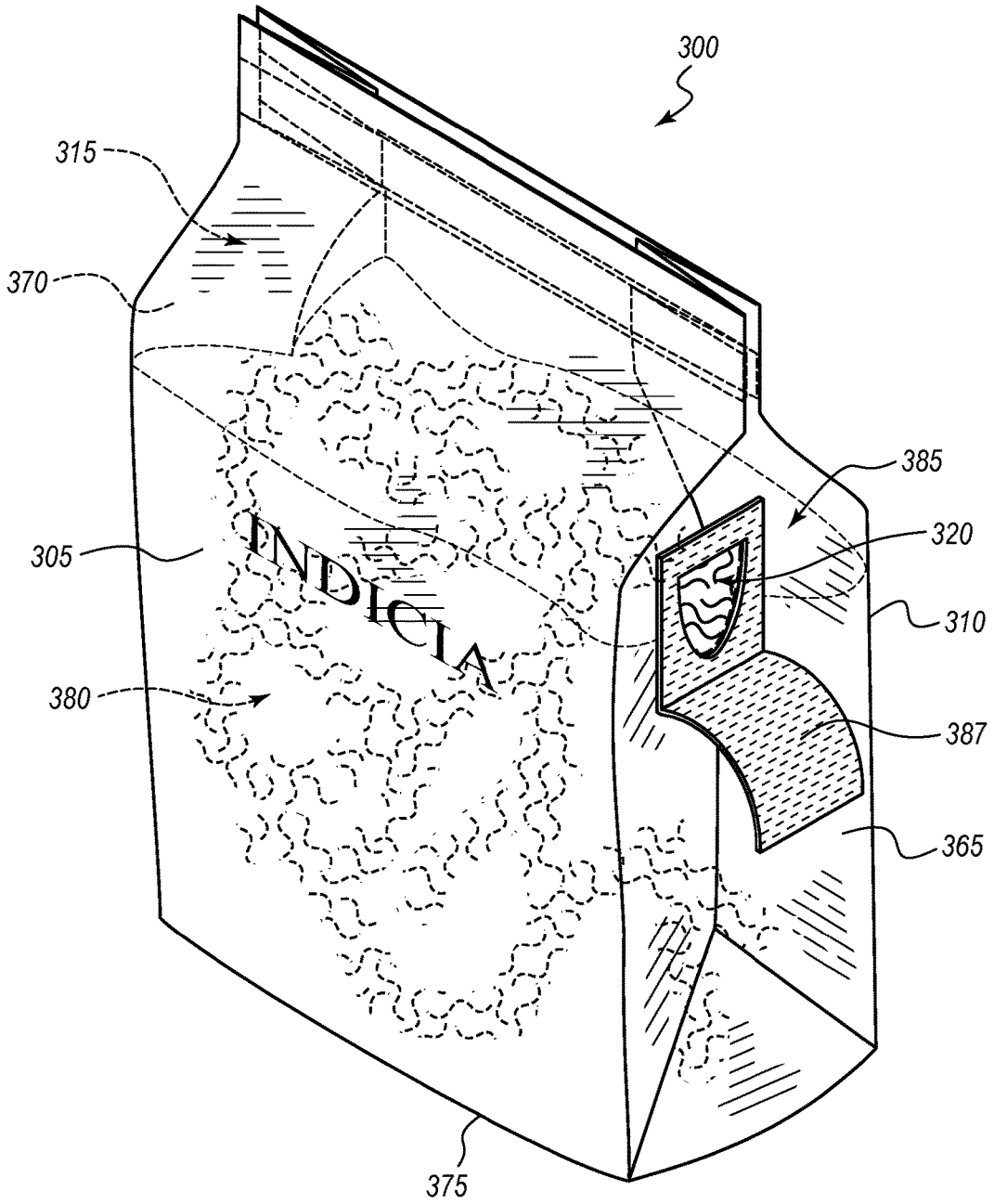
FIG. 9 is a perspective view of the bag of FIG. 8 wherein the resealable opening is in an open or unsealed configuration.

FIGS. 8 and 9 depict an embodiment of a resealable opening 385, according to the present disclosure. More specifically, FIG. 8 is a perspective view of a bag 300 comprising a resealable opening 385 wherein the resealable opening 385 is in a closed or sealed configuration, and FIG. 9 is a perspective view of the bag 300 wherein the resealable opening 385 is an open or unsealed configuration.

As shown in FIGS. 8 and 9, the bag 300 may comprise a first wall 305, a second wall 310, a first gusset 365, and a second gusset 370. The bag 300 may also comprise a third wall 375. As stated above regarding FIGS. 1 and 2, although FIGS. 8 and 9 primarily depict the first wall 305 and first gusset 365, it will be appreciated that the second wall 310 and second gusset 370 may comprise the same or similar features. For example, the second gusset 370 may be the same as, or substantially the same as, the first gusset 365, except that in the illustrated embodiment the second gusset 370 may not comprise the resealable opening 385 and associated elements (e.g., label 321). The second wall 310 may also be the same as, or substantially the same as, the first wall 305. In other embodiments the resealable opening 385 may be positioned on the first wall 305, the second gusset 370, the second wall 310, or the third wall 375, or the resealable opening 385 may bridge a wall and a gusset (e.g., the resealable opening 385 may be positioned such that it extends across a junction of the first wall 305 and the second gusset 370). As such, the discussion herein regarding many features of the first wall 305 and the first gusset 365 is equally applicable to the second wall 310 and second gusset 370, even though the features may not be specifically depicted.

With continued reference to FIGS. 8 and 9, the first wall 305, second wall 310, first gusset 365, second gusset 370, and the third wall 375 may cooperate to define a cavity 315 in the interior of the bag 300. An opening 320 is configured to provide access to the cavity 315. Further, at least a portion of the resealable opening 385 is coupled to an outside surface of the bag 300 such that the resealable opening 385 is configured to resealably close or seal the opening 320. As depicted, the opening 320 is disposed along an upper portion of the first gusset 365 of the bag 300. In other embodiments, the opening 320 may be disposed along a portion of the first wall 305, the second wall 310, the third wall 375, or the second gusset 370, or the opening 320 may extend across a junction between a wall and a gusset. The opening 320 may also be disposed at various positions along the first wall 305, second wall 310, first gusset 365, or second gusset 370. For example, the opening 320 may be positioned at a lower portion, a middle portion, or an upper portion of the bag 300 in relation to the third wall 375.

When the resealable opening 385 is in the undeployed configuration, as shown in FIG. 8, the opening 320 may be blocked, or otherwise closed, and access to the cavity 315 of the bag 300 may be denied, limited, or otherwise restricted. Further, a label 321 may be used to cover the opening 320 and deny access to the cavity 315 of the bag 300. The label 321 may also provide tamper evidency so that the user may know whether the bag 300 has been previously opened or whether contents of the bag 300 may have been compromised. For example, the opening 320 may comprise a tamper evidency mechanism. In some embodiments, a destructive label and/or perforated bag may provide a tamper evidency function. Such a mechanism may provide a consumer or user with confidence that the bag 300 or package has not been tampered with or previously opened.

Figure 10:
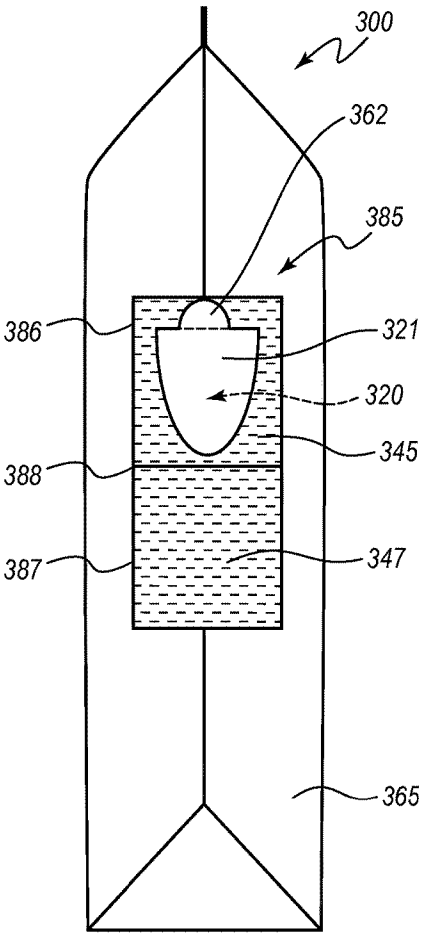
FIG. 10 is a plan view of the resealable opening of FIG. 9 in an open or unsealed configuration.

FIG. 10 is a plan view of the resealable opening 385 of FIG. 8. In the illustrated embodiment of FIG. 10, the label 321 is disposed over the opening 320. The label may be adhesively attached or coupled to a portion of the resealable opening 385, and/or the label 321 may be adhesively attached or coupled to the first gusset 365 of bag 300. The label 321 may also be peelable and/or removable. For example, the label 321 may be a removable perforated label that may be partially, or completely, removed from the bag 300. The opening 320 can be sealed by the removable perforated label when the bag is in a closed configuration The label 321, as illustrated, comprises a pull tab 362 configured to ease removal of the label 321 from the bag 300. In some embodiments, the label 321 may optionally comprise one or more pull tabs, like pull tab 362. The pull tabs may be gripped by a user to assist in peeling or otherwise removing the label 321 from the bag 300. For example, a user may grasp the pull tab 362 and pull the label 321 away from the first gusset 365 to remove the label 321. In certain embodiments, the opening 320 may be configured for easy opening. For example, a closed or sealed opening 320 may be configured such that a user may be able to open the opening 320 without the use of a tool or utensil.

In some embodiments, the label 321 is non-resealable. In other words, the label 321 may be intended to be removed from the bag 300 and/or the resealable opening 385 and discarded. In other embodiments, the label 321 may be resealable, and may be reattached onto the first gusset 365 of the bag 300 and/or a portion of the resealable opening 385 by the user. For example, the label 321 may comprise a resealable adhesive. The resealable adhesive may be disposed on a surface of the label 321, an outside surface of the bag 300 (e.g., the first gusset 365 of the bag 300), and/or a portion of the resealable opening 385. A user may remove the label 321 to gain access to the contents 380 within the bag 300. The user may thereafter place the label 321 back over the opening 320 and reseal the label 321 on the first gusset 365 and/or the resealable opening 385. Illustrative resealable adhesives that may be used include, but are not limited to, hook and loop fasteners, hook and hook fasteners, acrylic adhesives, polyurethane adhesives, and hot melt adhesives. Other types of resealable adhesives may also be used.

In some embodiments, the opening 320 may be formed by removing material from the first gusset 365 during the manufacturing of the bag 300 and/or removing material from at least a portion of the resealable opening 385. For example, the opening 320 may be die cut out of the first gusset 365 and/or the resealable opening 385. The opening 320 may also be laser scored and removed from the first gusset 365 and/or the resealable opening 385. In other embodiments, material is not removed from the first gusset 365 during the manufacturing of the bag 300 and/or from the resealable opening 385 to form the opening 320. Rather, tear lines may be formed on the first gusset 365 and/or the resealable opening 385 such that a segment of material from the first gusset 365 and/or the resealable opening 385 may be removed by a user when the bag 300 is initially opened. The tear lines may be die cut, laser scored, or formed by other suitable methods.

In certain embodiments, tear lines may be formed on the first gusset 365 and/or the resealable opening 385 to define an opening region and a label 321 can be placed over the tear lines and opening region. The label 321 may also be adhesively attached to the segment of material within the tear lines. As the label 321 is removed, the segment of material from the first gusset 365 and/or the resealable opening 385 that is adhesively attached to the label 321 may be torn along the tear line and removed from the first gusset 365 and/or the resealable opening 385 thereby forming the opening 320. In other embodiments, the opening may be opened and closed with a zipper seal.

As shown in FIG. 9, when the bag 300 is in the open or unsealed configuration, the opening 320 may provide access to the cavity 315 of the bag 300. The opening 320 may be sized and/or shaped to provide desired access to the cavity 315. For example, the opening 320 may be sized to allow the contents 380 of the bag 300 to be poured and/or shaken from the bag 300. As can be appreciated, the size and/or shape of the opening 320 may vary. For example, the size and/or shape of the opening 320 may vary depending on the size and/or shape of the contents that are contained in the bag 300. In another example, the size and/or shape of the opening 320 may vary depending on the desired rate of flow of the contents. In some embodiments, the shape of the opening may be substantially circular, oval, rectangular, semicircular, square, or triangular. Other shapes and/or sizes of the opening 320 are also contemplated. In certain embodiments, the bag 300 may be configured such that the contents 380 are pourable from the bag 300 in a controlled, metered, and/or smooth fashion, wherein directed flow of the poured contents 380 may be maximized and scattered or untidy spreading of the poured contents 380 may be minimized. In some embodiments, the resealable opening 385 and opening 380 may create a "shower head" effect when pouring content 380 from the bag 300. This may be beneficial where scattering of the contents of the bag 300 is intended.

Any variety of material may be used to form the bag 300. For example, in some instances, the material may be relatively stiff such that the bag 300 is sufficiently rigid to hold or maintain its structure or conformation. In other embodiments, the material that forms the bag may be relatively flexible.

In some embodiments, the bag 300 may comprise a single-layer film. In other embodiments, the bag 300 may comprise a multi-layer film. The bag 300 may also comprise a single ply or the bag 300 may comprise two or more plies. The bag 300 may also comprise a laminate or a coextruded material. In some embodiments, the bag 300 comprises a heat-sealable material. Exemplary materials that may be used in forming the bag 300 include polyethylene polymers and copolymers, polypropylene polymers and copolymers, polyester polymers and copolymers, and/or polyamide polymers and copolymers. In some embodiments, the bag 300 may include paper and/or cardboard materials alone or in combination with films, plies, laminates, or coextruded materials. In other embodiments, the bag 300 may not include paper and/or cardboard materials. In some embodiments, the bag 300 may include PLA. In further embodiments, the bag 300 may include cellulose materials such as cellophane. In still other embodiments, woven polypropylene may be used. Other materials are also contemplated.

In many embodiments, the bag 300 may be manufactured on existing machinery. Likewise, in many embodiments, the material of which the bag 300 is ultimately formed may be selected such that the material may be formed into the bag 300 on existing converting equipment. Further, the bag 300 may advantageously be manufactured on existing equipment, such that investment in new and expensive bag manufacturing equipment may be unnecessary. In some embodiments, the bag 300 may run on a user's manufacturing line at parity speeds. In other embodiments, the resealable opening 385 may be applied to the bag 300 on converting equipment. Additionally, the manufacture of bag 300 may be conducted at parity speeds.

In certain embodiments, the bag 300 may also comprise printed indicia of any suitable variety. The printed indicia may be disposed on any portion of the bag 300, such as the first wall 305, second wall 310, first gusset 365, second gusset 370, and/or third wall 375.

In some embodiments, the bag 300 may be configured to stand upright. In other words, the bag 300 may be capable of standing on its own. The bag 300 may also be substantially capable of maintaining its structural conformation. As shown in FIGS. 8 and 9, the third wall 375 may serve as a base on which the bag 300 rests. The first wall 305, second wall 310, first gusset 365, and second gusset 370 extend upwardly from the third wall 375. The first wall 305, second wall 310, first gusset 365, and second gusset 370 may also be attached or otherwise directly coupled to the third wall 375. In other embodiments, one or more of the first wall 305, second wall 310, first gusset 365, and second gusset 370 may be integrally formed with the third wall 375. As described above for other embodiments, a variety of bag styles may be used in combination with the resealable opening 385.

With continued reference to FIGS. 8 and 9, the first wall 305, second wall 310, first gusset 365, second gusset 370, and third wall 375 may cooperate to define the cavity 315 in the interior of the bag 300. The cavity 315 may receive and retain the contents 380, as shown in FIG. 9, wherein the contents 380 are shown in phantom. At a user's discretion, the contents 380 may be removed from the cavity 315 through the opening 320 and via the resealable opening 385. The contents 380 may comprise, for example, pet food, or other loose bulk products. Other suitable contents 380 may also be retained within the cavity 315 of the bag 300. In some embodiments, the bag 300 may be composed of material suitable to act as a barrier layer to preserve the contents 380 retained within the cavity 315.

Referring again to FIG. 10, the resealable opening 385 may comprise a first panel 386, wherein the first panel 386 is coupled to the outside surface of the bag 300 and is configured to at least partially surround the opening 320. As shown, the resealable opening 385 further comprises a second panel 387, or resealable cover, wherein the second panel 387 is coupled to the first panel 386 via a hinge 388. An outside surface of the first panel 386 comprises a first fastener region 345 and an inside surface of the second panel 387 comprises a second fastener region 347, wherein the first fastener region 345 and the second fastener region 347 comprise a fastener that is configured to couple the first panel 386 to the second panel 387. In other embodiments, the opening 320 and the resealable opening 385 may be disposed at another location on the bag 300. For example the opening 320 and the resealable opening 385 may be positioned on the first wall 305, the second wall 310, the second gusset 370, or any other suitable location on the bag 300. The resealable opening 385 may be configured to resealably close the opening 320. Additionally, in the illustrated embodiment of FIG. 9, the second panel 387 remains coupled to the outside surface of the bag 300 when the resealable opening 385 is in the unsealed configuration. In some embodiments, the first and second fastener regions 345, 347 may comprise a fastener selected from at least one of a hook and loop fastener, a hook and hook fastener, an acrylic adhesive, a polyurethane adhesive, a hot melt adhesive, or another suitable fastener and/or adhesive.

Figure 12:
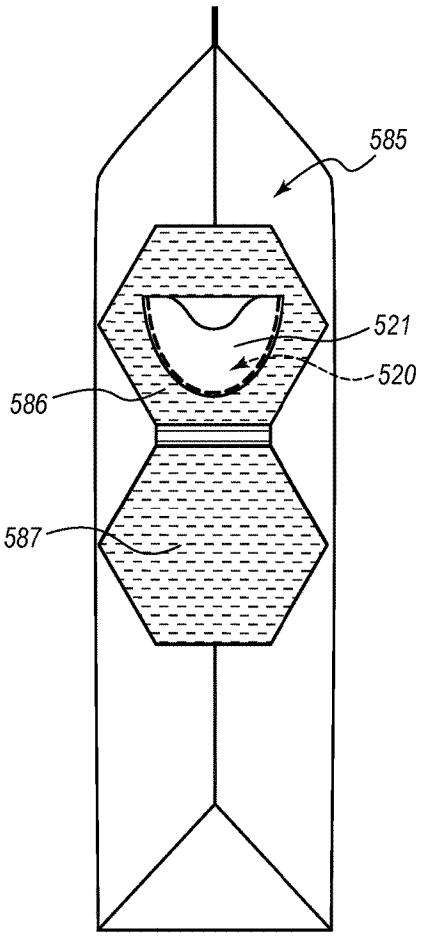
FIG. 12 is a plan view of another embodiment of a resealable opening in an open or unsealed configuration.
Figure 11:
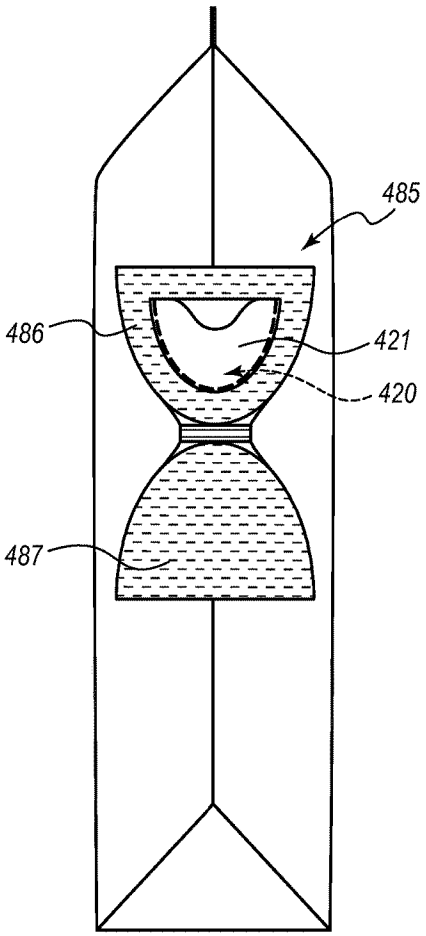
FIG. 11 is a plan view of another embodiment of a resealable opening in an open or unsealed configuration.

In the illustrated embodiments of FIGS. 10, 11, and 12, the first panels 386, 486, 586 surround the openings 320, 420, 520, respectively. In other embodiments, the first panels 386, 486, 586 may only partially surround the openings 320, 420, 520, respectively. In some embodiments, the hinge 388 may be a living hinge. As used herein, a "living hinge" describes a hinge that is thin and flexible and that comprises the same material as the two pieces it connects. The label 321 is illustrated as comprising an optional pull tab 362 that may be configured to ease removal of the label 321. As shown in FIG. 10, the resealable opening 385 can comprise first and second panels 386, 387 that are substantially square or rectangular. In contrast, the resealable opening 485 of FIG. 11 comprises first and second panels 486, 487 that are substantially semicircular, wherein the shape of the first and second panels 486, 487 substantially mirrors the shape of the opening 420. Referring to FIG. 12, the panels 586, 587 of the resealable opening 585 are substantially hexagonal. As depicted in FIGS. 10-11, in some embodiments, a resealable opening may comprise panels of various shapes and/or sizes. The shape and or size of the panels and/or opening can be configured according to the intended use of the bag. For example, a bag intended for relatively large and heavy contents may comprise a relatively large opening and panels with relatively large fastener regions. A variety of shapes and/or sizes of panels and/or openings is within the scope of this disclosure.

As can be appreciated, the bag can be shorter than what is depicted in FIGS. 1-12. For example, in some embodiments, a ratio of the height of a bag to its width can be less than, or greater than, what is shown in FIGS. 1-12. Other relative configurations are also contemplated.

In various embodiments, the bag may be configured as a stand-alone package. For example, the bag may be capable of standing on its own, and may be presented independently or individually on a market shelf. In other embodiments, multiple bags may be packaged together, such as in shrink-wrap packaging. In still other or further embodiments, one or multiple bags may be packaged in a box.

Although much of the foregoing disclosure is discussed in the context of packaging for loose bulk products, it should be appreciated that embodiments of bags disclosed herein may be used for other items. The bags may be formed in a variety of sizes and configurations. In some instances, some variations in addition to size may exist between the smaller and larger format bags. For example, in some embodiments, larger format bags may be formed of a stiffer material. The stiffer material may aid in maintaining the bag shape and allowing the bag to stand on its own. The stiffer material also may aid in maintaining the opening in an open configuration, as a width of the opening can be bigger for the larger format packages. Other alterations are also possible, such as omitting or including various seams or seals and/or, where seams or seals are present, increasing or decreasing a width of each seam or seal.

Any methods disclosed herein comprise one or more steps or actions for performing the described method. The method steps and/or actions may be interchanged with one another. In other words, unless a specific order of steps or actions is required for proper operation of the embodiment, the order and/or use of specific steps and/or actions may be modified.

References to approximations are made throughout this specification, such as by use of one or more of the terms "about," "approximately," "substantially," and "generally." For each such reference, it is to be understood that, in some embodiments, the value, feature, or characteristic may be specified without approximation. For example, where such a qualifier is used, the term includes within its scope the qualified word in the absence of the qualifier.

Reference throughout this specification to "an embodiment" or "the embodiment" means that a particular feature, structure, or characteristic described in connection with that embodiment is included in at least one embodiment. Thus, the quoted phrases, or variations thereof, as recited throughout this specification are not necessarily all referring to the same embodiment. Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any embodiment requires every feature shown in a particular drawing.

Unless otherwise noted, the terms "a" or "an" are to be construed as meaning "at least one of." In addition, for ease of use, the words "including" and "having" are interchangeable with and have the same meaning as the word "comprising." Recitation of the term "first" with respect to a feature or an element does not necessarily imply the existence of a second or an additional such feature or element.

The claims following this written disclosure are hereby expressly incorporated into the present written disclosure, with each claim standing on its own as a separate embodiment. This disclosure includes all permutations of the independent claims with their dependent claims. Moreover, additional embodiments capable of derivation from the independent and dependent claims that follow are also expressly incorporated into the present written description.

Without further elaboration, it is believed that one skilled in the art can use the preceding description to utilize the invention to its fullest extent. The claims and embodiments disclosed herein are to be construed as merely illustrative and exemplary, and not a limitation of the scope of the present disclosure in any way. It will be apparent to those having ordinary skill in the art, with the aid of the present disclosure, which changes may be made to the details of the above-described embodiments without departing from the underlying principles of the disclosure herein. In other words, various modifications and improvements of the embodiments specifically disclosed in the description above are within the scope of the appended claims. The scope of the invention is therefore defined by the following claims and their equivalents.

The invention claimed is:

1. A bag, comprising:

a first wall;

a second wall, wherein the first wall and the second wall cooperate to define at least a portion of a cavity;

an opening configured to provide access to the cavity;

a collapsible spout coupled to an outside surface of the bag such that the collapsible spout is configured to resealably close the opening; and a removable label that is coupled to the bag at a position between the opening and the collapsible spout such that the removable label seals the opening when the bag is in a closed configuration.

2. The bag of claim 1, wherein the collapsible spout comprises:

a panel comprising a first end, a first lateral end, and a second lateral end, wherein the first end is coupled to the outside surface of the bag at a position that is adjacent an edge of the opening;

a first gusset extending from the first lateral end of the panel to the outside surface of the bag at a position that is adjacent a first lateral edge of the opening; and a second gusset extending from the second lateral end of the panel to the outside surface of the bag at a position that is adjacent a second lateral edge of the opening.

3. The bag of claim 2, wherein both the first gusset and the second gusset comprise a fold such that at least a portion of the first gusset and at least a portion of the second gusset bias toward each other when the collapsible spout transitions from a deployed configuration to an undeployed configuration.

4. The bag of claim 2, wherein the collapsible spout is configured to fold into a substantially flat state when the collapsible spout transitions from a deployed configuration to an undeployed configuration.

5. The bag of claim 2, wherein the first end of the panel remains coupled to the outside surface of the bag when the collapsible spout is in a deployed configuration.

6. The bag of claim 2, wherein the panel of the collapsible spout comprises a fastener region disposed on an inner surface of the panel, the fastener region comprising a fastener that is configured to couple the panel of the collapsible spout to at least a portion of the outside surface of the bag.

7. The bag of claim 1, wherein the collapsible spout comprises:

a first panel comprising a first end, a first lateral end, and a second lateral end, wherein the first lateral end is coupled to the outside surface of the bag at a position that is adjacent a first lateral edge of the opening, and wherein at least a portion of the first end is coupled to the outside surface of the bag at a position that is adjacent an edge of the opening; and a second panel comprising a first end, a first lateral end, and a second lateral end, wherein the first lateral end of the second panel is coupled to the second lateral end of the first panel, wherein the second lateral end of the second panel is coupled to the outside surface of the bag at a position that is adjacent a second lateral edge of the opening, and wherein the first end of the second panel is coupled to at least one of an outside surface of the first end of the first panel and the outside surface of the bag at a position that is adjacent the edge of the opening.

8. The bag of claim 7, wherein the first panel further comprises a fold such that at least a portion of the first panel biases toward the opening when the collapsible spout transitions from a deployed configuration to an undeployed configuration.

9. The bag of claim 7, wherein the first panel of the collapsible spout comprises a first fastener region disposed on an outside surface of the first lateral end, the first fastener region comprising a fastener that is configured to couple at least a portion of the first lateral end to a second fastener region disposed on an outside surface of the second lateral end.

10. The bag of claim 1, wherein the removable label is a peelable label that is adhesively attached to the outside surface of the bag when the bag is in the closed configuration.

11. The bag of claim 1, wherein the removable label is a removable perforated label.

12. The bag of claim 1, further comprising:

a first gusset disposed between the first wall and the second wall at a first lateral end of the bag;

a second gusset disposed between the first wall and the second wall at a second lateral end of the bag; and a third wall positioned between a first end of the first wall and a first end of the second wall, wherein the third wall comprises a first end and a second end, wherein the first end of the third wall is coupled to the first end of the first wall, wherein the second end of the third wall is coupled to the first end of the second wall, and wherein both the opening and the collapsible spout are positioned on at least one of the first wall, the second wall, the first gusset, or the second gusset.

13. The bag of claim 12, wherein both the opening and the collapsible spout are positioned on at least one of the first wall or the second wall.

14. The bag of claim 12, wherein both the opening and the collapsible spout are positioned on at least one of the first gusset and the second gusset.

15. A bag, comprising:

a first wall;

a second wall, wherein the first wall and the second wall cooperate to define at least a portion of a cavity;

an opening comprising a tear line disposed around a segment of material forming at least one of the first wall or the second wall, wherein the segment of material is removable by a user to provide access to the cavity; and a resealable cover coupled to an outside surface of the bag at a position that is adjacent the opening, the resealable cover comprising:

a fastener region disposed on an inner surface of the resealable cover, the fastener region comprising a fastener that is configured to couple the resealable cover to the outside surface of the bag;

a first panel, wherein the first panel is coupled to the outside surface of the bag and is configured to at least partially surround the opening; and a second panel, wherein the second panel is coupled to the first panel via a hinge, wherein an outside surface of the first panel comprises a first fastener region and an inside surface of the second panel comprises a second fastener region, wherein the first fastener region and the second fastener region comprise a fastener that is configured to couple the first panel to the second panel, wherein the resealable cover is configured to resealably close the opening, and wherein a portion of the resealable cover remains coupled to the outside surface of the bag when the resealable cover is in an unsealed configuration.

16. The bag of claim 15, wherein the hinge is a living hinge.

17. A bag comprising:

a first wall;

a second wall, wherein the first wall and the second wall cooperate to define at least a portion of a cavity;

an opening comprising a tear line disposed around a segment of material forming at least one of the first wall or the second wall, wherein the segment of material is removable by a user to provide access to the cavity;

a resealable cover coupled to an outside surface of the bag at a position that is adjacent the opening, wherein the resealable cover is configured to resealable close the opening, and wherein a portion of the resealable cover remains coupled to the outside surface of the bag when the resealable cover is in an unsealed configuration;

a first gusset disposed between the first wall and the second wall at a first lateral end of the bag;

a second gusset disposed between the first wall and the second wall at a second lateral end of the bag; and a third wall positioned between a first end of the first wall and a first end of the second wall, wherein the third wall comprises a first end and a second end, wherein the first end of the third wall is coupled to the first end of the first wall, wherein the second end of the third wall is coupled to the first end of the second wall.

* * * * *